US009328606B2

(12) United States Patent
D'Angelo et al.

(10) Patent No.: US 9,328,606 B2
(45) Date of Patent: May 3, 2016

(54) METHOD AND DEVICE TO MEASURE PERFORATION TUNNEL DIMENSIONS

(75) Inventors: Ralph M. D'Angelo, New Fairfield, CT (US); Harvey Williams, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 861 days.

(21) Appl. No.: 12/985,922

(22) Filed: Jan. 6, 2011

(65) Prior Publication Data

US 2012/0176862 A1 Jul. 12, 2012

(51) Int. Cl.
*G01V 1/00* (2006.01)
*E21B 47/10* (2012.01)

(52) U.S. Cl.
CPC ..... *E21B 47/101* (2013.01)

(58) Field of Classification Search
USPC ..... 367/33, 35, 49; 181/105
See application file for complete search history.

(56) References Cited

U.S. PATENT DOCUMENTS 4,130,816 A 12/1978 Vogel et al.
4,587,641 A 5/1986 Difoggio
4,709,357 A * 11/1987 Maki, Jr. ..... 367/35
4,852,069 A 7/1989 Clerke et al.
4,949,316 A 8/1990 Katahara
4,987,969 A 1/1991 Boyle et al.
5,218,573 A * 6/1993 Katahara ..... G01V 1/50 367/32
5,412,990 A 5/1995 D'angelo et al.
5,436,791 A 7/1995 Turano et al.
5,441,110 A 8/1995 Scott, III
5,444,598 A 8/1995 Aresco
5,521,882 A 5/1996 D'angelo et al.
5,676,213 A 10/1997 Auzerais et al.
5,717,169 A 2/1998 Liang et al.
5,970,434 A 10/1999 Brophy et al.
6,188,643 B1 2/2001 Liang et al.

(Continued)

FOREIGN PATENT DOCUMENTS

EP 37650 A1 10/1981
EP 304053 A2 2/1989

(Continued)

OTHER PUBLICATIONS

Ultrasonic Sound, http://hyperphysics.phy-astr.gsu.edu/hbase/sound/usound.html, Apr. 2000.*
Kino, Gordon S., "Chapter 3—Section 3.2: Plane Piston Transducers", Acoustic Waves: Devices, Imaging, and Analog Signal Processing, Prentice-Hall Inc.: Englewood Cliffs, 1987, pp. 164-165.

(Continued)

*Primary Examiner* — Krystine Breier
(74) *Attorney, Agent, or Firm* — Jeffrey R. Peterson; Tuesday Kaasch

(57) ABSTRACT

A method of logging a perforation tunnel and associated features of the perforation tunnel can include the following features. A logging device including an ultrasonic transducer is located downhole into a well. The well has a casing. The ultrasonic transducer has a focal point that is a distance from the ultrasonic transducer so as to be behind the inner face of the casing. An ultrasonic signal is projected from the ultrasonic transducer. A reflection of the ultrasonic signal is reflected from an internal portion of the perforation tunnel, the perforation tunnel extending through the casing and into formation. A transit time is measured between transmission and reception of the ultrasonic signal. A position of the ultrasonic transducer corresponding to the ultrasonic transmission and reception of the reflected signal is determined.

26 Claims, 10 Drawing Sheets

(56) References Cited

U.S. PATENT DOCUMENTS

| | | | | |
|---|---|---|---|---|
| 6,483,777 | B1 * | 11/2002 | Zeroug | 367/35 |
| 6,732,798 | B2 | 5/2004 | Johnson et al. | |
| 8,096,355 | B2 * | 1/2012 | McDaniel et al. | 166/250.1 |
| 8,522,611 | B2 * | 9/2013 | Frumin et al. | 73/152.16 |
| 2006/0018190 | A1 | 1/2006 | Brooks | |
| 2007/0104027 | A1 | 5/2007 | Brooks | |

FOREIGN PATENT DOCUMENTS

| | | | |
|---|---|---|---|
| EP | 376580 | B1 | 8/1993 |
| RU | 2174242 | C1 | 9/2001 |

OTHER PUBLICATIONS

Hyde-Barber et al., Ultrasound Logging Techniques for the Inspection of Sand Control Screen Integrity, SPE International, Apr. 2011, SPE 143315.

International Search Report and Written Opinion issued in PCT/US2012/020057 on Aug. 29, 2012, 10 pages.

Office Action issued in CO13184473 on Jul. 24, 2014, 11 pages.

Office Action issued in MX/A/2013/007894 on Aug. 19, 2014, 3 pages.

Office Action issued in RU2013136568 on Oct. 10, 2014, 6 pages.

Decision to Grant in related RU application 2013136568 on Jan. 14, 2015, 7 pages.

* cited by examiner

METHOD AND DEVICE TO MEASURE PERFORATION TUNNEL DIMENSIONS

TECHNICAL FIELD

The present application generally relates to measurement of perforation tunnels in oil wells, and more specifically to measurement of depth and other dimensions of perforation tunnels with an ultrasonic pulse and reflection of such.

BACKGROUND

The productivity of oil and gas fluids from subterranean formations is typically controlled by casing and perforating the wellbore. To maximize the return of the well, perforation properties are optimized through their vertical placement, phasing and internal morphology. If observations of perforation properties may be taken in situ, then stimulation services may be optimally designed to increase productivity or injectivity. Specifically, for old and new wells, to optimize the performance it is desirable to know the open perforation tunnel length.

Accordingly, the present application provides a number of preferred embodiments that address many of those and related issues.

SUMMARY

The following description is a brief synopsis of a combination of features according to a preferred embodiment of the present application.

A method of logging a perforation tunnel and associated features of the perforation tunnel can include the following features. A logging device including an ultrasonic transducer is located downhole into a well. The well has a casing. The ultrasonic transducer has a focal point that is a distance from the ultrasonic transducer so as to be behind the inner face of the casing. An ultrasonic signal is projected from the ultrasonic transducer. A reflection of the ultrasonic signal is reflected from an internal portion of the perforation tunnel, the perforation tunnel extending through the casing and into formation. A transit time is measured between transmission and reception of the ultrasonic signal. A position of the ultrasonic transducer corresponding to the ultrasonic transmission and reception of the reflected signal is determined.

This summary is not meant in any way to unduly limit any claims related to this application and is merely meant to present a summary of some preferred combinations of features according to preferred embodiments in the present application. Many preferred embodiments can include different combinations including other features.

DETAILED DESCRIPTION

Figure 1:
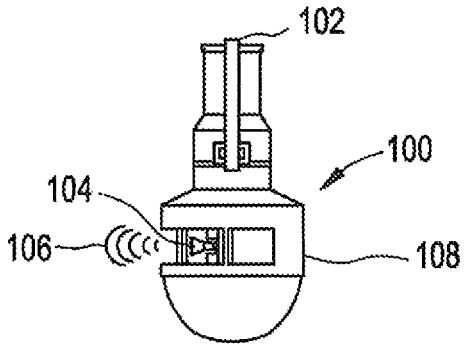
FIG. 1 is a side view of an ultrasonic transducer according to preferred embodiments.

In the following description, numerous details are set forth to provide an understanding of the preferred embodiments. However, it will be understood by those skilled in the art that embodiments according to the present application may be practiced without many of these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

To extract hydrocarbons or other valuable fluids from subterranean formations, wells are created that extend into the ground. To support these wells, provide isolation of reservoir zones, and deter cave-ins, among other things, casings are often provided. These casings are cemented in place and line the wellbore. In order to extract fluids from the formation into the wellbore, holes (perforations), which are often generally circular in cross section and tubular or "carrot" in shape, are created through and beyond the casing into the formation. Perforations are the starting point for natural completions, acidizing, gravel packing and fracturing. Each application has different requirements of the perforation morphology: from short and fat to narrow and long. In open-hole perforating, where there is no casing lining the wellbore similar procedures take place.

Measurement of the open perforation tunnel length is most desirable in determining which perforating stimulation services may be applied to a completion to increase the well's performance.

To create holes or perforations, perforating guns are lowered into the wellbore. The perforating guns contain a plurality of shaped charges that fire projectiles through the casing and into the earth formation thereby creating holes in the casing and perforation tunnels in the formation. Where debris material has been removed, or otherwise ejected into the wellbore, an open perforation tunnel results. Hereinafter, we may refer to the open perforation tunnel as the tunnel. Where material from the shaped charge, the formation or the casing is deposited in the perforation, debris is present.

The entrance hole in the casing may fall in the range of 0.17 to 0.45 inches for natural completions, and be larger for other applications. Behind the casing: typically, the tunnel depth (Lpen in FIG. 4) can be up to 59 inches, however the open tunnel length (Lop in FIG. 4) is typically much less; likewise the maximum tunnel diameter is typically one to three times casing entrance hole diameter, but in certain circumstance larger again.

The small casing hole and the larger internal void will represent a premier challenge for anyone attempting an acoustic measurement of the depth of a perforation tunnel.

Firstly, the casing has very high acoustic impedance, ensuring that nearly all of the energy striking it is reflected back towards the transmitting device. This insures that the backscattered glare is very intense relative to the weak signal resulting from a perforation hole. An analogy of this would be using a flashlight, in a dark room, to find a small pit in a mirror. Essentially all the investigator would see is the reflected energy of the light source.

Secondly, the small perforation hole through the casing makes it even more challenging to get energy directly into the perforation. Since the exact location of these perforation holes is difficult to determine, the acoustic device may be scanned in azimuth and depth, meaning that the preferred embodiment is to deploy the device on the measurement tool. However, the acoustic device could be stationary. This ensures some amount of beam spreading will occur as the acoustic beam travels from the transmitter to the casing inner surface.

A challenge for an ultrasonic measurement becomes detecting a reflection from the end of the perforation tunnel, over the large backscatter signal of the casing reflection, having such a small entry hole to work with. Since that backscatter signal contains components that reverberate between the casing and the transducer face, and since the wellbore fluid is typically of a low acoustic speed, these reverberations can extend a great deal in time.

According to preferred embodiments, at least two techniques can be used simultaneously to reduce the amplitude of this backscatter noise relative to the amplitude of the tunnel end reflection:

1) orient the transmitting/receiving ultrasonic transducer system at a standoff distance, relative to the casing, that is reduced to the point that these multiple reverberations decay faster in time so as to allow for differentiation from signals reverberating from inside a perforation tunnel.

Figure 9:
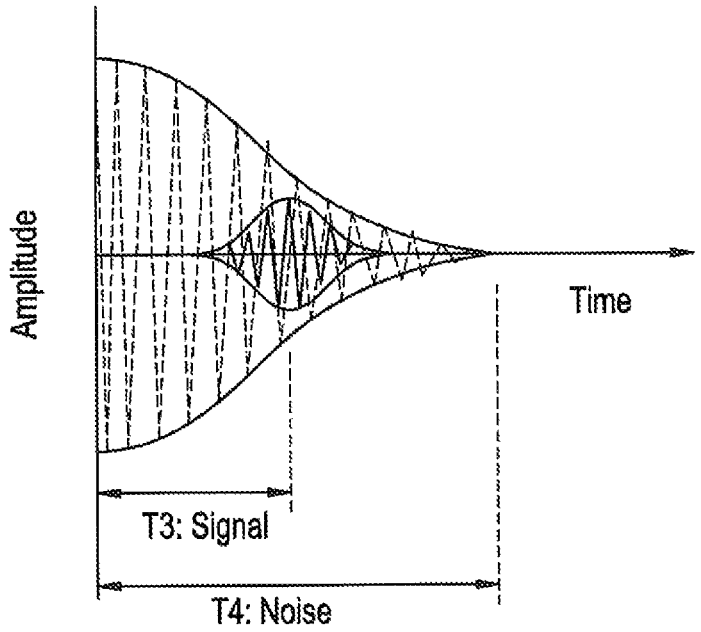
FIG. 9 is a diagram showing return noise and return signal amplitude over time.
Figure 10:
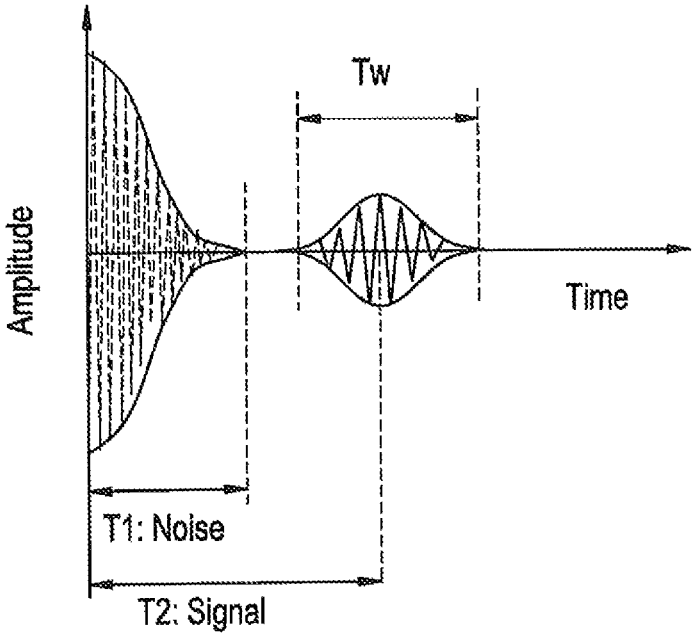
FIG. 10 is a diagram showing return noise and return signal amplitude over time.

2) choose transducer parameters that produce a beam profile, or shape, that provides a beneficial signal to noise ratio. In this case, the signal is the portion of the transmitted energy that enters the perforation through the small hole in the casing, reflects from the end of the open tunnel section, and returns back to the receiving transducer to be received. The noise is the transmitted energy that reflects back to the receiving transducer from the steel casing and the layers behind it, or other structures contained in the wellbore. By choosing transducer parameters along specific well-defined guidelines, one can produce a strong reflected signal relative to the amplitudes of the reflected noise events, in the time window of the returned signal. This idea is illustrated in FIGS. 9 and 10.

As the stand-off distance between the transducer and the casing inner surface is decreased, the time spacing of the reverberation echoes occurring between the two also decreases. Since each multiple echo involves yet another partial reflection from the transducer face or from the casing surface, each multiple echo contains less energy. Thus, decreases in transducer standoff relative to the casing lead to the amplitudes of the multiple echoes decaying to a very low level rapidly.

Since the attributes of the fluid of propagation are the same or similar in both the travel of the energy to the casing and to the open tunnel end, the speed is essentially always the same. Thus, the timing can become a geometry situation. Empirically, we have shown that by using a focused transducer that is focused beyond the casing, an acceptable amplitude level of the casing reverberations is achieved after about 3 reverberation cycles. Thus, according to a preferred embodiment, it follows that we can measure an open tunnel that is as short as 3 times the standoff distance. Using this relationship, it is possible to select a standoff based on the minimum perforation depths expected to be measured.

Figure 4:
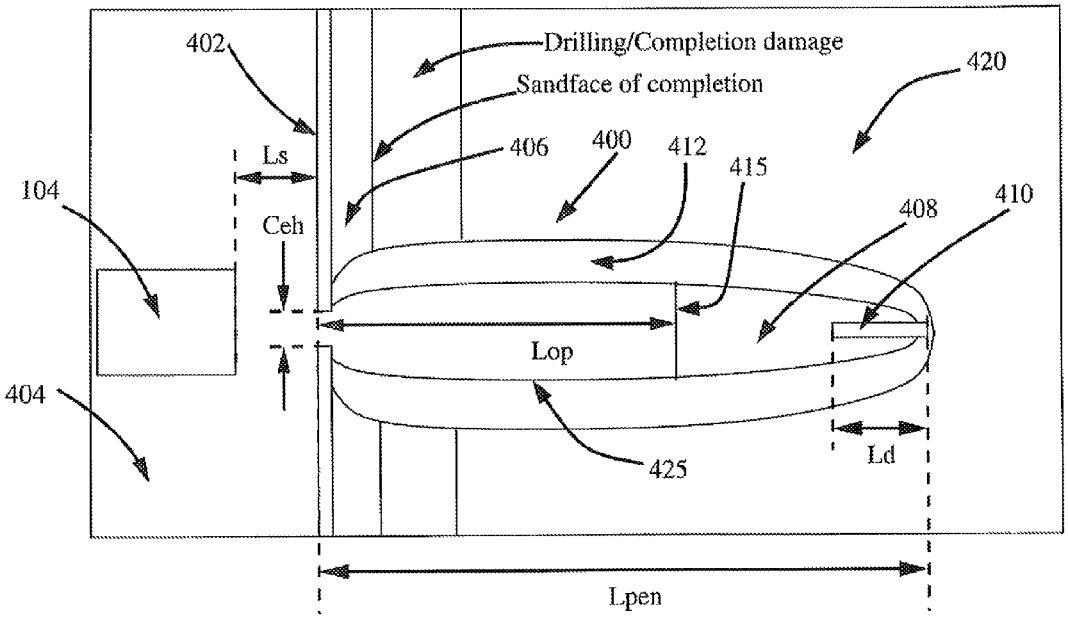
FIG. 4 is a side view schematic of a perforation tunnel in relation to an ultrasonic transducer according to preferred embodiments.

FIG. 4 shows a transducer 104 used in a pulse-echo mode, meaning that it is both the transmitter and receiver device. The transducer standoff distance, Ls, can be set to 20 mm and the fluid can be water. Thus, based on the above discussion, we expect to be able to measure a 60 mm open perforation tunnel. Such a tunnel length would have a reflection that arrives at 80 microseconds. This illustration includes the cement 406 that is used to secure the casing 402.

Figure 5A:
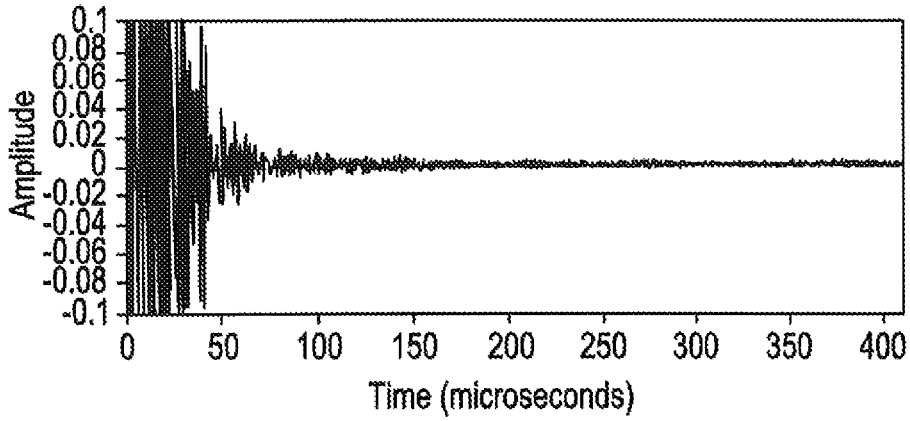
FIGS. 5*a* and 5*b* are plots of ultrasonic signals received by an ultrasonic transducer according to preferred embodiments.
Figure 5B:
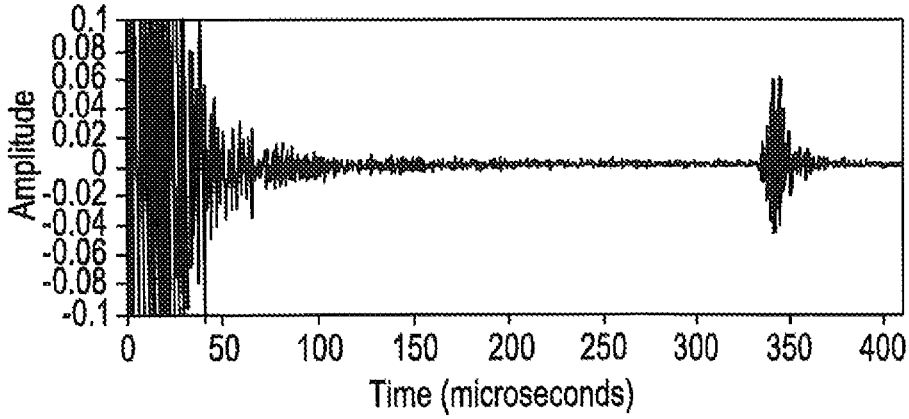

The plot of FIG. 5*a* shows the reflected signal returned to the transducer when it is exciting a section of casing having no perforation hole. The large signals that occur between 0 and 100 microseconds are the reverberations between transducer and casing. FIG. 5B shows the reflected signal returned to the transducer when it is exciting a section of casing having a perforation hole, as shown in FIG. 4. The signal at about 340 microseconds is the arrival of a signal that made the round trip through the standoff distance, to the tunnel end 415, and back to the transducer. This time, in water, taken as 1500M/Sec., represents a total distance traveled of 510 mm. Dividing by two for the one way travel distance and subtracting off the 20 mm standoff, we have measured an open tunnel length, Lop, of approximately 235 mm. The large signal occurring between zero time and approximately 70 microseconds is the casing reverberation noise. It is clear that using this system, it is possible to detect an open tunnel reflection that arrived at 80 microseconds. Thus, preferred embodiments include designs of the measurement system that establish a transducer standoff which reduces the reverberation noise to negligible levels at the point in time that the perforation tunnel signal is measured, as described above.

According to preferred embodiments, a second technique is utilized to increase this signal-to-noise ratio. The first technique served to reduce the time extent of the casing reflected noise. This second technique serves to increase the ratio of the amplitude of the signal returned by the end of the open perforation tunnel to the casing noise level.

On exciting the transducer, a beam (signal) of a finite shape is propagated in the fluid, toward the casing. For circular, planar transducers, the shape and size of that beam depends on the transducer diameter, the operating frequency, and the acoustic speed of the propagation media.

For the problem of maximizing the amount of energy of a transducer that enters the small hole of a casing perforation, one solution is to use a narrow, confined beam. If a transducer could emit a perfectly collinear beam, having a smaller diameter than the hole in the casing, once the beam was aligned centered on the hole, the returned signal would have none of the casing reflection noise described above, and only contain the tunnel end reflection. However, getting such a highly collimated beam, at transducer diameters below 0.2" would require extremely high frequency, which is problematic due to attenuation in the wellbore fluid.

As the beam propagates away from a circular, planar transducer, it starts as a rather confined beam, having a beam width that is roughly the same as the transducer diameter. This is known as the near-field region of the beam, also known as the Fresnel length. As it propagates further, the beam begins to spread more rapidly in circular width. This region is known as the far-field. "Acoustic Waves: Devices, Imaging, and Analog Signal Processing", Kino, Gordon. S., Prentice-Hall, Inc., 1987, which is incorporated herein by reference in its entirety, explains that the end of the near-field is given as when S=1, for:

$S=Z\lambda/a^2$, where

Z=the distance of propagation from the transducer,

λ=the wavelength, and a=the transducer radius;

or, rewritten for S=1, and expressing λ as speed over frequency, the near-field end point is roughly when:

$a^2=Zc/f$, where f=frequency, and c=speed of media.

To use this relationship for specifying a transducer that will provide the collinear beam desired, we start with the given knowledge of the desired standoff distance determined above for reduced reverberation time. Since it is preferable to have the near-field range extend beyond the 20 mm standoff chosen, we choose a near-field range of triple the standoff, or Z=0.060M. This margin of safety ensures a collinear beam well past the casing interface, deep into the perforation tunnel. Next, we choose a frequency. From the above equation, it is clear that if frequency is too low (i.e., below 300 kHz.) the transducer diameter will be too large for a borehole configuration. If frequency is too high, (i.e., above 5.0 MHz.) the absorption and scattering losses of the wellbore fluids will diminish the signal strength. 1.0 MHz is a preferred frequency. Taking the wellbore fluid to be water, having an acoustic speed of 1500M/Sec., the equation can now be solved for the transducer radius, 'a', as:

a=SQRT(0.060M*1500M/Sec/1.0 MHz), or a=0.0095M, or 9.5 mm.

Thus, the diameter of the transducer is 9.5 mm. The Panametrics V303-SU immersion, circular, planar transducer is preferable for this application and is commercially available and known as Olympus-Panametrics Transducer circular planar transducer (from Olympus-NDT of Waltham, Mass.).

An alternate method of increasing the amplitude of the signal returned by the end of the open perforation tunnel is to shape the beam in a focused manner. By having an emitted beam profile that focuses to a small spot-size behind the inside casing surface, all, or most of the energy from the transducer will enter the perforation. It will then travel along various paths towards the tunnel end, and reflect back to the transducer. The amount of back-scatter noise from the inner surface of the casing will be acceptably low. The result is a very favorable signal-to-noise ratio.

In designing the parameters for a focused transducer, again first consideration is given to the preferred casing standoff, chosen above, 20 mm. The optimal improvement in signal-to-noise ratio will occur if the focal spot diameter is less than the casing hole size, and the focal point occurs at a point just beyond the casing, or at a standoff distance of at least equal to the casing standoff plus at least a portion of the casing thickness (i.e., behind the inner face of the casing). Taking 10 mm as a typical casing thickness number, we get a focal length of 30 mm. To keep the degree of focus of the transducer, or F number, to a reasonable level, we choose a transducer diameter that is on the order of half the focal length. Since diameters of 0.5 inches (13 mm) are a preferred transducer size, this will be preferable. Also, the significant focusing used here allows reduction of the operating frequency somewhat, to lessen sensitivities to attenuation.

From Kino (noted earlier) we also get a description of the calculation of this spot size, in SI units, which are rewritten slightly in form as:

Beam Diameter(−6 dB)=(1.02*Fc)/fD, where

F is the focal length of the transducer c is the sound speed in the wellbore fluid f is the frequency of the transducer D is the diameter of the transducer element.

Thus, we calculate a −6 dB beam diameter of 7.22 mm, for a 0.5" diameter transducer, focused at 30 mm, operating at 500 kHz, in water. A transducer that fits this criterion can be acquired from Ultran Laboratories, Inc. of State College, Pa., as a customized version of part number LS100-0.5-P76.

According to preferred embodiments, a method of determining the length of an open perforation tunnel includes lowering an ultrasonic transducer device (configured as noted above) downhole. An ultrasonic pulse is transmitted into the perforation tunnel and the time for the pulse to return to the transducer from reflection off the casing and from reflection from the interior of a perforation tunnel is measured. Based on the transit time and the speed of the ultrasonic pulse in the wellbore fluid, the length of the open perforation tunnel can be calculated.

There are a number of methods according to preferred embodiments that can be used to measure the perforation tunnel's depth and dimensions. For example, one method includes locating the ultrasonic transducer directly adjacent to and facing into the perforation tunnel. The ultrasonic transmission into the perforation tunnel is measured and used to determine the length of the open perforation tunnel. Also, the returning signal can be used to determine the presence and dimensions of debris at the end of the perforation tunnel.

Another method involves movement of the transducer over the interior of the casing (or wellbore in open hole), and a repeated transmission of an ultrasonic pulse and reception of the reflection. Essentially, the wellbore and perforation tunnels are mapped. From the return signals, the data can be gathered and used to determine the location of perforation tunnels, the depth and dimensions of the perforation tunnels, and the dimensions of debris at the end of the perforation tunnels, can be determined. See this idea illustrated in FIG. 7.

In connection with the ultrasonic transducer device being moved while transmitting pulses of an ultrasonic signal, the speed of the transducer should be taken into account so that the speed is slow enough to enable reception of the reflected pulse by the transducer. If the transducer moves at a high speed, a separate transducer can be positioned adjacent to the transducer that transmits the pulse so that one transducer can be used to transmit ultrasonic pulses and another transducer can be used to receive the return signals.

The location of the ultrasonic transducer can be recorded and correlated to the recorded data. The detected data (transducer location, time between transmission and reflection, and amplitude of reflection) can be plotted to create a representation of perforation tunnels (e.g., a map of the wellbore), showing the location, depth and width of the open perforation tunnels (i.e., the portion of a perforation tunnel that is open and free from debris). Also, the amplitude of the response can be plotted (e.g., grayscale pixel(s) or color pixels corresponding to the amplitude of the response ultrasonic signal) to depict the shape and location of debris in the perforation tunnel.

Figure 2:
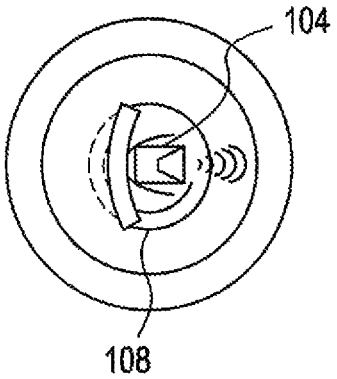
FIG. 2 is a top view schematic of an ultrasonic transducer according to preferred embodiments.

Looking visually at some preferred embodiments, FIG. 1 shows an example of a perforation tunnel measuring device (PTMD) 100. The PTMD 100 has a housing 108 (FIG. 2) that has an ultrasonic transducer 104 contained within. The ultrasonic transducer 104 produces an ultrasonic signal 106 that is transmitted away from the PTMD 100 in a radial direction. An electrical connection 102 (for example a metal electrical conductor) connects to the ultrasonic transducer 104. The electrical cable 102 can conduct electricity to power the transducer 104 and other electrically driven parts (e.g. a motor). The PTMD 100 can rotate and be driven by a motor. The ultrasonic transducer 104 can serve both as a transmitter of an ultrasonic pulse and a receiver of a reflected pulse. That is, the transducer 104 converts electrical energy to ultrasonic energy and sends out an ultrasonic pulse 106 and then receives the reflected ultrasonic energy of that ultrasonic pulse 106 and converts the ultrasonic energy to an electrical signal. It is also possible that one ultrasonic transducer 104 is used to transmit an ultrasonic pulse 106 and another ultrasonic transducer is used to receive a reflection. Particularly, a second ultrasonic transducer is used if the speed of the PTMD 100 is fast enough that the return signal would miss the transducer 104 upon reflection and return.

The ultrasonic transducer 104 can transmit an ultrasonic signal with a frequency at least as high as 300 kHz and up to 5000 kHz, but preferably only as high as around 3000 kHz. The PTMD 100 can measure both the amplitude of the reflected ultrasonic signal and the transit time from when the signal leaves the PTMD 100 to when the signal reflects and returns.

The transducer 104 can be a focused beam ultrasonic transducer, which creates a converging waveform with a focal point hence allowing a greater portion of the ultrasonic energy created by 104 to enter the casing entrance hole and perforation tunnel. Alternatively, the transducer 104 can be a planar transducer.

Figure 3:
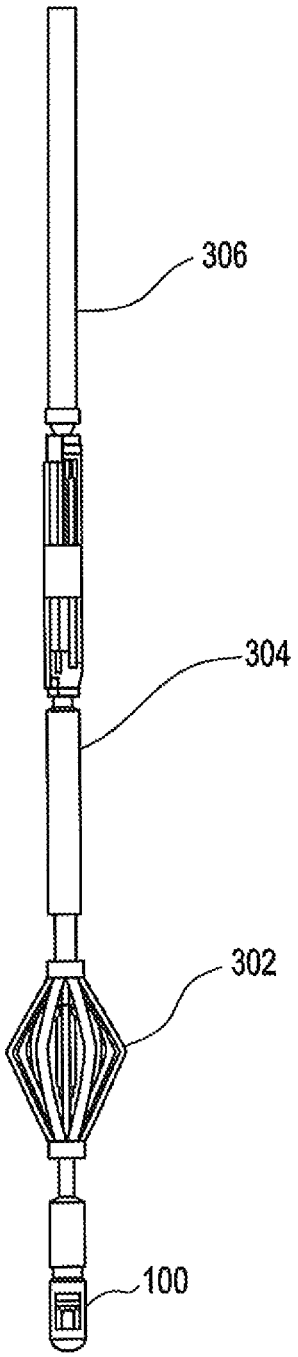
FIG. 3 is a side view schematic of a logging tool according to preferred embodiments.

FIG. 3 is a representation of a system including the PTMD 100 that can be used downhole. The PTMD 100 is shown as being part of a measurement sonde 304. A centralizer 302 is located around the sonde 304. That is, the sonde 304 extends through the center of the centralizer 302. When the device is lowered in the wellbore, the centralizer 302 extends outward from the sonde 304 and contacts the wellbore or the casing to locate the device in the center of the wellbore along the wellbore's central axis. An electronics module 306 can be connected with the sonde 304. The electronics module can include a processor, as noted above, that performs various functions such as processing signals and determining the transit time and the amplitude of the reflected ultrasonic signal. The processor can also have memory (e.g., flash memory) for recording collected data. Alternately, the electronics module 306 can lack those components and, for example, merely control the rotation of the PTMD 100 and other control functions. Or, the electronics module can lack a processing capability and only record raw data. The reception and determination of transit time and amplitude can be done by a separate processor removed from the sonde 304. The data can be presented visually on a digital display device, e.g., a computer monitor or screen.

FIG. 4 shows a side view representing the ultrasonic transducer 104 that can be used as part of the PTMD 100 where the ultrasonic transducer 104 is positioned with respect to a perforation tunnel 400. The perforation tunnel 400 has a crushed zone 412, which is bounded on the inside by tunnel wall 425, which is in contact with wellbore fluid 404. The outside of the crushed zone 412 is bounded by the virgin formation rock 420. The end of the open perforation tunnel 415 could be the perforation debris 408 and or the liner debris 410 which has length Ld. Alternatively, the end of the open perforation tunnel could be the virgin reservoir rock 420, if there is no perforation crushed zone 412 or debris 408. Debris can be cleaned after perforation.

The PTMD 100 is lowered in the wellbore and wellbore fluid 404. Over the course of movement, the ultrasonic transducer 104 is located adjacent to a perforation in the casing 402 and a corresponding perforation tunnel 400. The width of the entrance hole in the casing (beginning of perforation tunnel) is Ceh. The distance of the ultrasonic transducer 104 from the inside of the casing is Ls. The length of the open perforation tunnel from the inside of the casing is Lop.

To measure the depth of the open perforation tunnel, the ultrasonic transducer 104 transmits an ultrasonic signal into the perforation tunnel 400. The ultrasonic signal travels to the end of the open perforation tunnel 415 and is reflected back to the ultrasonic transducer 104 by the end of the open perforation tunnel 415, often formed by the beginning of tunnel debris 408. The time for the signal to travel from the ultrasonic transducer 104 and to reflect back to the ultrasonic transducer 104 is measured. This can be done either while the ultrasonic transducer 104 is stationary in front of a perforation tunnel, or moving past the perforation tunnel slowly.

The following formula can be used to calculate the length of the open perforation tunnel 400. If the speed of sound in the wellbore fluid is Cf and Top is the time taken for the signal in FIG. 5*b* to return to the ultrasonic transducer 104, then the open perforation tunnel length Lop can be calculated by using the following formula:

$$Lop=Top*Cf/2.0-Ls$$

The value for the speed of the wellbore fluid, Cf, is approximated as in most cases it is largely a brine solution, the velocities of which are very close to water. Alternatively, the wellbore fluid can be accurately measured at the surface. Preferably, it can be measured downhole using a separate ultrasonic device.

The value of the standoff distance, Ls, also should be known. This value can be approximated by knowing the borehole, or casing, inner radius and the distance of the sensor face from the center of the logging tool. The difference of these values would be the mean standoff value. However, in practice this value varies significantly with tool rotation, especially in horizontal or highly deviated wells, where the tool is often at an eccenter. It is preferred to derive the standoff at each measurement location.

Each reflected pulse contains some amount of transducer-to-casing reverberation signal, discussed as noise above. Each of those reverberations is separated in time by an interval that is based on the fluid speed, Cf, and the standoff distance, Ls. By measuring the time between any two of these events, and using the known value of Cf, one can determine the standoff, Ls.

An alternate method of determining Ls is to use these same reverberations but to process them in the frequency domain. Performing a Fast Fourier Transform on a selected number of these reverberations will yield their characteristic frequency. The time between the events is the inverse of this frequency.

Then, by whichever of the above methods is used to derive the time between these reverberation signals, one calculates Ls by:

$$Ls=(\text{Interval Time}/2)*Cf$$

FIG. 5 shows the data recorded as a result of the ultrasonic transducer 104 transmitting the ultrasonic signal. FIG. 5*a* shows the signal received by the PTMD 100 when the ultrasonic transducer 104 is not facing a perforation tunnel. There, the signal travels from the ultrasonic transducer 104 and reflects off the inside of the casing 402 and returns with a detectable amplitude in a short period of time, e.g. under 50 microseconds. That transit time corresponds to the distance Ls, as does the reverberations between multiple transducer-casing reflections. In FIG. 5*b*, the signal travels from the ultrasonic transducer 104 into the perforation tunnel 400 and returns with a detectable amplitude at about 340 microseconds. That is, the signal shown in FIG. 5*b* is transmitted from the ultrasonic transducer 104, travels into the perforation tunnel 400 and contacts internal parts of the tunnel 425 and 415, and reflects back to the ultrasonic transducer 104. FIG. 5B also shows the reverberation signal reflecting off the casing too. From a series of ultrasonic signal transmissions, measurement of the axial location of the transducer 104 and angular position of the transducer 104, the location and depth of perforation tunnels can be plotted. For example, the data collected can together be used to plot the position of the ultrasonic transducer 104 on an axis of a chart and the time for a pulse to return can be plotted on another axis, as shown in FIG. 5*b*. Also, the amplitude of the reflected pulse can be represented as a grayscale of two or more levels (or color scale) pixel or series of pixels, as shown in FIG. 7, wherein we see three perforation tunnels.

Figure 6A:
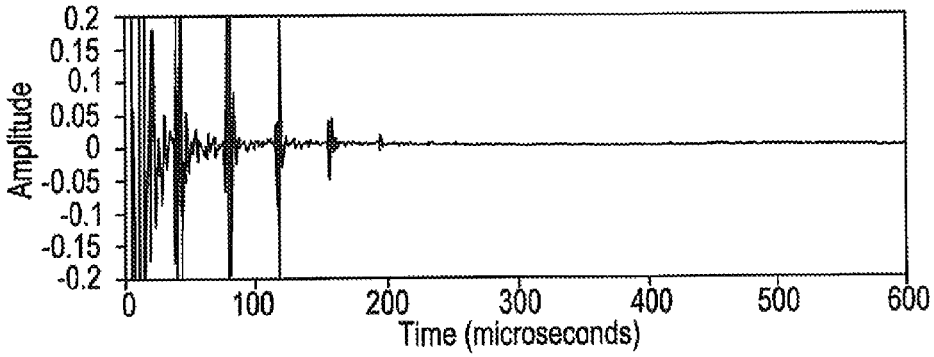
FIGS. 6*a* and 6*b* are plots of ultrasonic signals received in open hole perforation according to preferred embodiments.
Figure 6B:
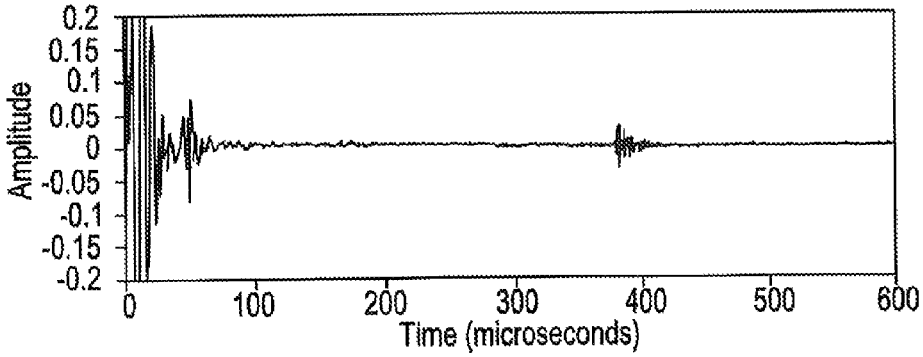

The same principal applies for open hole perforations (no wellbore casing). FIG. 6 shows signals detected by the PTMD 100 in an open hole perforation where FIG. 6*a* shows the reflection of the ultrasonic signal from the wellbore formation wall (including reverberations) and FIG. 6*b* shows the signal returning after traveling into and reflecting at the end of an open perforation tunnel.

One way to detect the width of a perforation tunnel is to move the PTMD 100 across a perforation tunnel opening and transmit an ultrasonic signal (or intermittent signals) over the course of travel. The path of travel for the PTMD 100 can be for example, circumferential, axial, or helical. The detected data over the course of travel of the PTMD 100 can then be charted where the Y-axis represents the distance traveled (position) of the PTMD 100 and the X-axis is the time for the signal to reflect and travel back to the PTMD 100. As shown in FIG. 7, the amplitude in this case is represented by a pixel or group of pixels where the darker (or color scale) pixel or group of pixels represents larger amplitude. Thus, as the PTMD 100 reaches the leading edge of the perforation tunnel the reflected signal takes more time to return to the PTMD 100. As the PTMD 100 crosses the trailing edge of the perforation tunnel the signal takes less time to return to the PTMD 100. From that representation the width of the perforation tunnel can be determined. For example, FIG. 7 shows perforation tunnels with diameters ranging approximately 10 mm to 25 mm.

Figure 7:
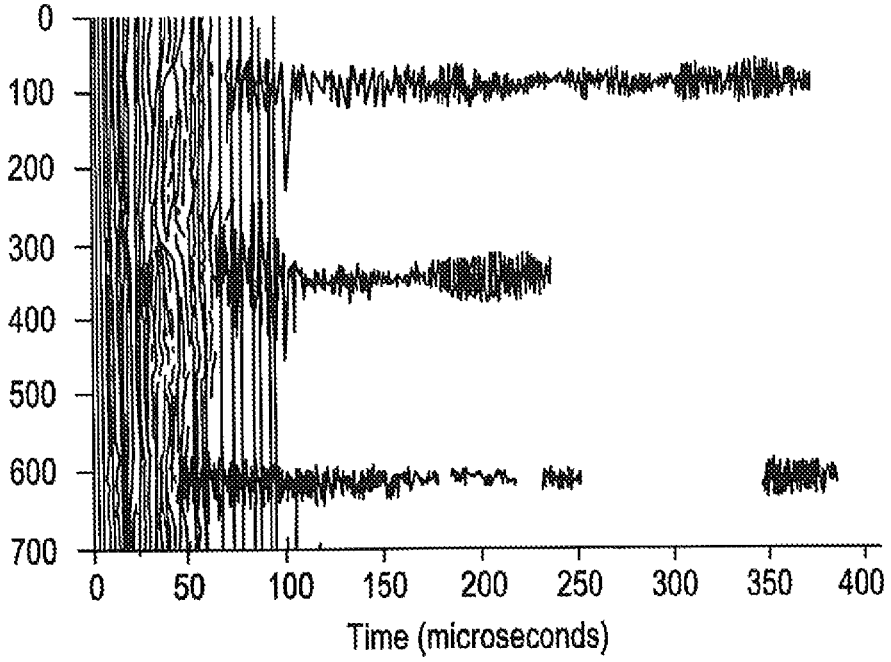
FIG. 7 is a plot of a position of ultrasonic transducer, transit time of an ultrasonic signal, and amplitude of the ultrasonic signal, where the amplitude is represented in grayscale.

The dimensions and location of debris 408 which can include liner material 410 and crushed zone 412 at the end of the perforation 400 can be determined by way of representations (plotted data) as shown in FIG. 7 (the distance parameter on the y-axis and/or the time parameter on the x-axis). The debris 408 at the end of the perforation tunnel 400 produces reflections over the course of the debris 408. That is, the ultrasonic signal reflects at the front of the debris 415, the middle portions of the debris 408, and all the way toward the end of the debris 408 at the end of the perforation tunnel 400. By plotting the position of the PTMD 100 as the Y-axis component, the time for the signal to return as the X-axis component, and the amplitude of the signal received as a gray scale pixel component (e.g., a dark(er) pixel or group of pixels as the signal has a larger amplitude), the attributes and dimensions of the debris (which can include liner debris and crushed zone) at the end of the perforation tunnels can be determined. For the purposes of this application, a two color threshold (i.e., grayscale of either black or white pixels) is considered to be cray scale. The same can be said for other colors instead of black or white. The darker portions shown in the chart indicate the higher amplitude reflections of the ultrasonic signals by the various portions of the debris 408 at the end of the perforation tunnels 400.

The preferred range of ultrasonic frequencies is from 300 kHz to up to 3000 kHz. The upper end of this range is bounded by two main factors. First, is the loss in the fluid. Whether it be scattering loss due to particulate or true absorption loss, at some point the signal may be attenuated too much to traverse an approximate 12" to 24" round trip. Second is grain scatter effect of the rock formation needed to reflect the signal. As the frequency gets very high, large-grained rock begins to be interpreted like a sponge to the incoming wave, and the reflection pulse can be scattered into "pieces", thus looking quite undefined. This upper frequency limit could begin to develop around 3 MHz.

The lower end of this range is dictated more by the geometric spreading of the beam coming from the transducer. Regardless of whether the front face of the transducer is focused (concave curved) or planar, as frequency goes down, the beam-width goes up. With transducers that can be mounted on borehole tools being limited to around 1.5" diameter, a low-end frequency limit of about 300 kHz is the minimum frequency one could expect to use and still have a beam that can interrogate a small diameter perforation.

A preferred frequency is in the range of 1.0 MHz to 3.0 MHz, and most preferably 1.0 MHz with, for example, a 0.5" diameter transducer (available planar or focused). Such a transducer is available from Panametrics Corporation, as P/N V303-SU.

Figure 8:
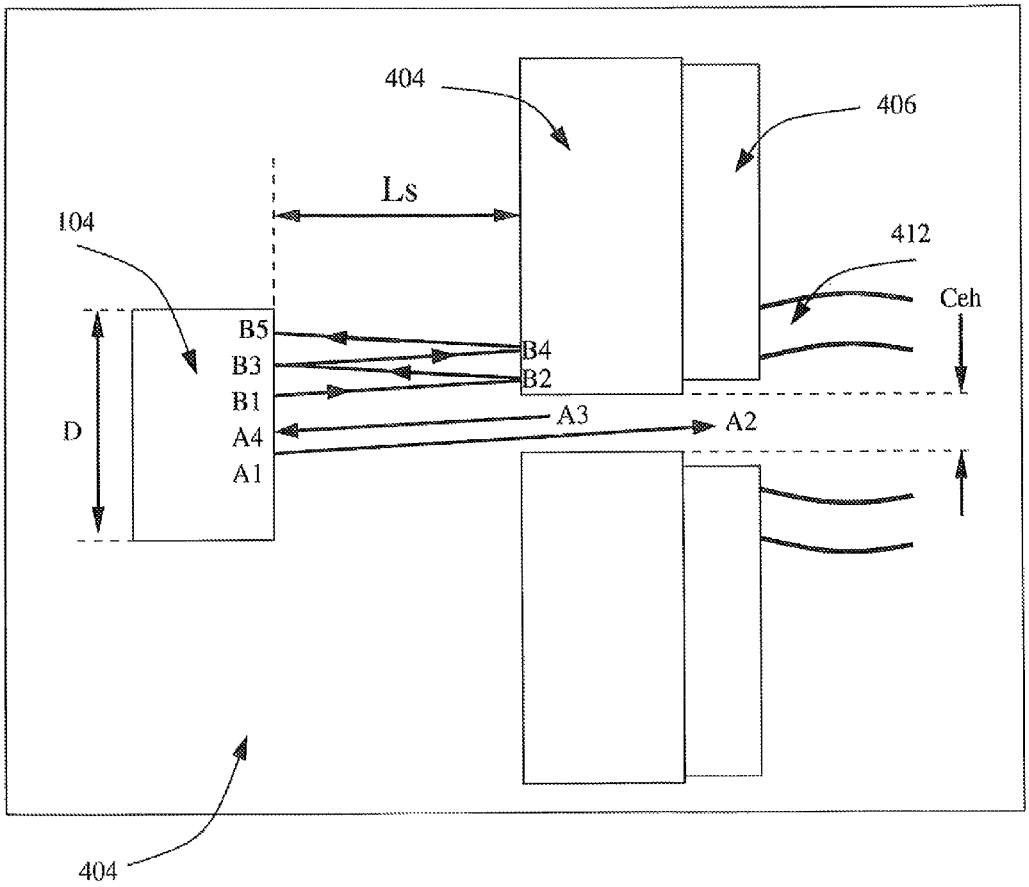
FIG. 8 is a diagram showing sonic reflection in a cased wellbore.

FIG. 8 shows the two dominant paths an ultrasonic pulse can take upon transmission from transducer 104. Path A1-A2 is a wave entering the perforation tunnel through the casing entrance hole. It does not reflect off the inner surface of the casing. A1-A2 ultimately reflects off the end of the open perforation 415 and returns to the transducer as A3-A4; this is the signal.

A second path is B1-B2-B3-B4. Here we have multiple reverberations between the transducer 104 and casing 404. These beam paths are the most likely source of noise and are detrimental to detecting the end of the open perforation tunnel 415.

Based on the various ultrasonic paths noted herein, varying degrees of noise can be produced depending on the configuration implemented. For example, FIG. 9 shows results where the configuration produces a large amount of noise. In FIG. 9, the noise occurs over a time T4, and the signal reflecting from within the perforation tunnel is centered at T3, which is within time T4. In this case, it is difficult to discern the characteristics of the signal.

In contrast, FIG. 10 shows results given a different configuration that minimizes the noise. There the noise is limited to time T1 and the signal is centered around time T2, and covers time Tw, which is distinguishable from T1. Therefore, it is possible to discern the characteristics of the signal from the noise. This result can be due to a particular advantageous configuration. For example, a result along these lines can be achieved by shaping the ultrasonic beam so that the beam is narrowed and focused to enter the perforation and avoid reflection from the casing 402, as seen in FIG. 13. In connection with focusing the beam, a proper standoff distance from the casing 402 can be selected to ensure the beam is focused into the perforation tunnel 400.

Figure 12:
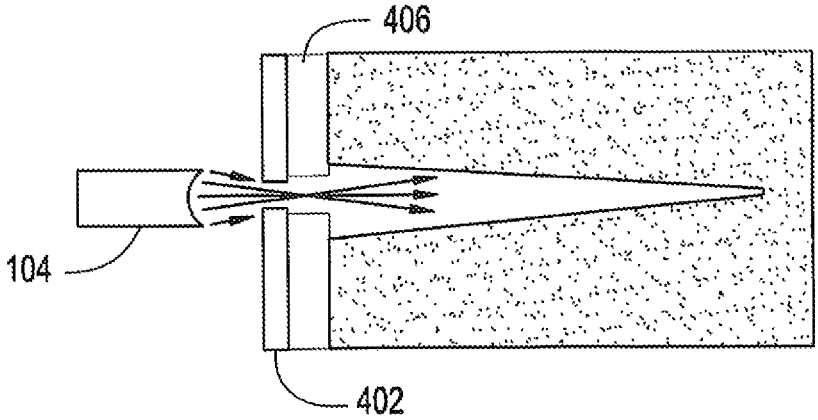
FIG. 12 shows a focused beam source.

When the standoff and beam diameter are chosen properly, as discussed above, and focused beyond the casing, as seen in FIG. 12, we can achieve the desired result of separating the time of perforation measurement signal from the noise from casing reflections, as shown in FIG. 10.

Figure 11:
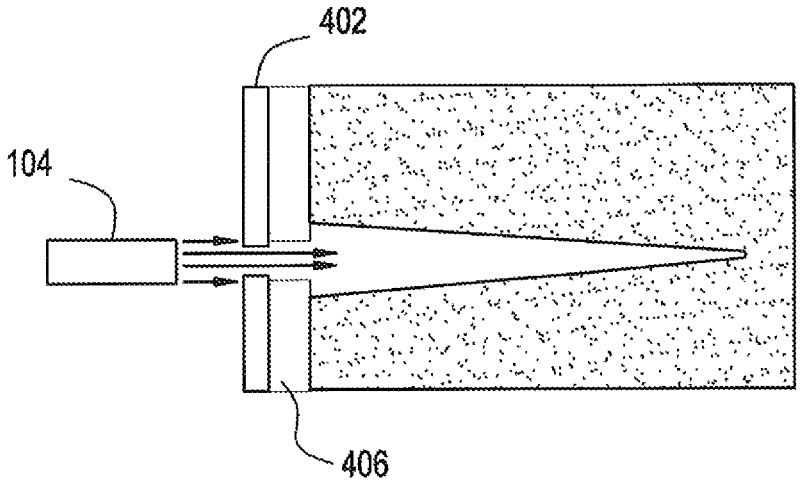
FIG. 11 shows a planar beam source.

As discussed above, a circular planar transducer can also be used to control this signal-to-noise ratio, by shaping the beam to be collinear and having a small diameter, as shown in FIG. 11.

The description herein is meant to provide one skilled in the art an understanding of the various embodiments and features and is no way intended to unduly limit the scope of any claims related to this application.

What is claimed is:

1. A method of logging a perforation tunnel and associated features of the perforation tunnel, comprising:

a) locating a logging device including an ultrasonic transducer into a well, the well having a casing, the ultrasonic transducer having a focal point that is a distance from the ultrasonic transducer so as to be behind the inner face of the casing;

b) projecting an ultrasonic signal from the ultrasonic transducer;

c) detecting a reflection of the ultrasonic signal from an internal portion of the perforation tunnel, the perforation tunnel extending through the casing and into formation;

d) measuring a transit time between transmission and reception of the ultrasonic signal;

e) determining a position of the ultrasonic transducer corresponding to the ultrasonic transmission and reception of the reflected signal;

f) repeating steps b)-e) multiple times and recording resultant data;

g) processing the resultant data with a computer and determining a dimension of the perforation tunnel; and wherein the ultrasonic transducer is located a standoff distance from the wellbore casing at least one-third of a length of a minimum open tunnel length required to measure;

the standoff distance being so that reflections from the casing reverberate and substantially dissipate before a reflection from inside the perforation tunnel is received by the ultrasonic transducer.

2. A method of claim 1, wherein the ultrasonic signal is within a range of 500 kHz to 5000 kHz.

3. A method of 1, wherein the ultrasonic signal is within a range of 300 kHz to 3000 kHz.

4. A method of 1, wherein the ultrasonic signal is approximately 1000 kHz.

5. A method of claim 1, comprising processing the resultant data with a computer and determining a dimension of debris in the perforation tunnel.

6. A method to detect perforation tunnels and associated features of the perforation tunnels, comprising:

a) lowering an ultrasonic transducer into a wellbore, the wellbore having a casing lining the wellbore, a perforation tunnel extending through the casing and into the formation;

b) positioning the ultrasonic transducer adjacent to and facing into the perforation tunnel, the ultrasonic transducer being a standoff distance from the casing so that reflections from the casing reverberate and substantially dissipate before a reflection from inside the perforation tunnel is received by the ultrasonic transducer;

c) projecting an ultrasonic signal;

d) detecting a reflection of the ultrasonic signal reflected from an internal portion of the perforation tunnel;

e) detecting a reflection of the ultrasonic signal reflected from the inside surface of the casing;

f) measuring transit times and amplitudes of the reflection from the casing and of the reflection from inside the perforation tunnel;

repeating steps b)-f) and recording the resultant data;

processing the resultant data with a computer and determining a depth of the perforation tunnel and a dimension of debris in the perforation tunnel.

7. The method of claim 6, comprising determining a position of the ultrasonic transducer corresponding to the ultrasonic transmission and reflection reception.

8. The method of claim 6, wherein the standoff distance is at least one-third a length of a minimum open tunnel length required to measure.

9. The method of claim 7, further comprising: configuring the signal diameter to be equal to or less than an expected width of an opening in the casing at the opening of the perforation tunnel.

10. A method of claim 6, wherein the ultrasonic transducer is a focused ultrasonic transducer and is focused at a point behind an inside surface of the casing.

11. A method of claim 10, wherein the signal diameter is determined by way of the following formula:

$$\text{Signal Diameter}(-6\text{ dB})=(1.02*Fc)/fD, \text{ wherein}$$

F is the focal length of the transducer;

C is the sound speed in the wellbore fluid;

f is the frequency of the transducer;

D is the diameter of the transducer element in SI units.

12. A method of determining a depth of a perforation tunnel, comprising:

lowering a logging device into a wellbore, the wellbore having a casing that lines the wellbore;

a perforation comprising a tunnel that extends through the casing into formation;

the logging device comprising an ultrasonic transducer;

positioning the ultrasonic transducer adjacent to the perforation so as to overlap the perforation in a direction extending along a central longitudinal axis of the perforation;

emitting an ultrasonic signal from the ultrasonic transducer into the perforation;

receiving reflections of the ultrasonic signal from inside the perforation tunnel; and determining the depth of the perforation tunnel and a dimension of debris in the perforation tunnel.

13. The method of claim 12, comprising:

using a processor to determine the depth of the perforation tunnel based on the signal received from reflecting inside the perforation.

14. A method of claim 12, comprising:

presenting the depth of the perforation tunnel on a digital visual display.

15. A method of claim 1, wherein the perforation tunnel has a circular cross section.

16. The method of claim 6, wherein the perforation tunnel has a circular cross section.

17. The method of claim 12, wherein the perforation has a circular cross section.

18. The method of claim 1, wherein the perforation tunnel has a tapered cylindrical shaped volume.

19. The method of claim 6, wherein the perforation tunnel has a tapered cylindrical shaped volume.

20. The method of claim 12, wherein the perforation has a tapered cylindrical shaped volume.

21. A method of logging a perforation tunnel and associated features of the perforation tunnel, comprising:

a) locating a logging device including an ultrasonic transducer into a well, the well having a casing, the ultrasonic transducer having a focal point that is a distance from the ultrasonic transducer so as to be behind the inner face of the casing;

b) projecting an ultrasonic signal from the ultrasonic transducer;

c) detecting a reflection of the ultrasonic signal from an internal portion of the perforation tunnel, the perforation tunnel extending through the casing and into formation;

d) measuring a transit time between transmission and reception of the ultrasonic signal;

e) determining a position of the ultrasonic transducer corresponding to the ultrasonic transmission and reception of the reflected signal;

f) repeating steps b)-e) multiple times and recording resultant data;

g) processing the resultant data with a computer and determining a dimension of the perforation tunnel and a dimension of debris in the perforation tunnel.

22. A method of claim 21, wherein the ultrasonic transducer is located a standoff distance from the wellbore casing at least one-third of a length of a minimum open tunnel length required to measure.

23. A method of claim 22, wherein the standoff distance being so that reflections from the casing reverberate and substantially dissipate before a reflection from inside the perforation tunnel is received by the ultrasonic transducer.

24. A method of claim 21, wherein the ultrasonic signal is within a range of 500 kHz to 5000 kHz.

25. A method of 21, wherein the ultrasonic signal is within a range of 300 kHz to 3000 kHz.

26. A method of 21, wherein the ultrasonic signal is approximately 1000 kHz.

* * * * *